United States Patent [19]

Hrovat et al.

[11] Patent Number: 4,600,610

[45] Date of Patent: Jul. 15, 1986

[54] MOLDED BODY FOR EMBEDDING RADIOACTIVE WASTE AND PROCESS FOR ITS PRODUCTION

[75] Inventors: Milan Hrovat, Rodenbach; Hans Huschka; Lothar Rachor, both of Hanau; Thomas Schmidt-Hansberg, Frankfurt; Reinhard Kroebel, Gondelsheim, all of Fed. Rep. of Germany

[73] Assignee: Nukem GmbH, Hanau, Fed. Rep. of Germany

[21] Appl. No.: 440,314

[22] Filed: Nov. 9, 1982 (Under 37 CFR 1.47)

[30] Foreign Application Priority Data

Nov. 11, 1981 [DE] Fed. Rep. of Germany ..... 3144754

[51] Int. Cl.[4] ..... G21F 9/16

[52] U.S. Cl. ..... 428/2; 252/628; 264/0.5; 428/76

[58] Field of Search ..... 428/2, 76, 903.3; 252/628; 241/DIG. 38; 264/0.5, 122

[56] References Cited

U.S. PATENT DOCUMENTS

| | | | |
|---|---|---|---|
| 4,167,491 | 9/1979 | Gablin et al. | 252/628 |
| 4,237,632 | 11/1980 | Lubowitz | 428/2 |
| 4,328,423 | 5/1982 | Lorenzo et al. | 252/628 |
| 4,407,742 | 10/1983 | Hrovat et al. | 252/628 |

*Primary Examiner*—Paul J. Thibodeau

*Attorney, Agent, or Firm*—Cushman, Darby & Cushman

[57] ABSTRACT

There are known molded bodies for the safe, long time fixation of radioactive and toxic wastes which have a matrix of graphite and inorganic binding agent, preferably nickel sulfide. An increased resistance to leaching is obtained with molded bodies that have a waste containing nucleus and a waste free shell made of the same graphite matrix.

21 Claims, 1 Drawing Figure

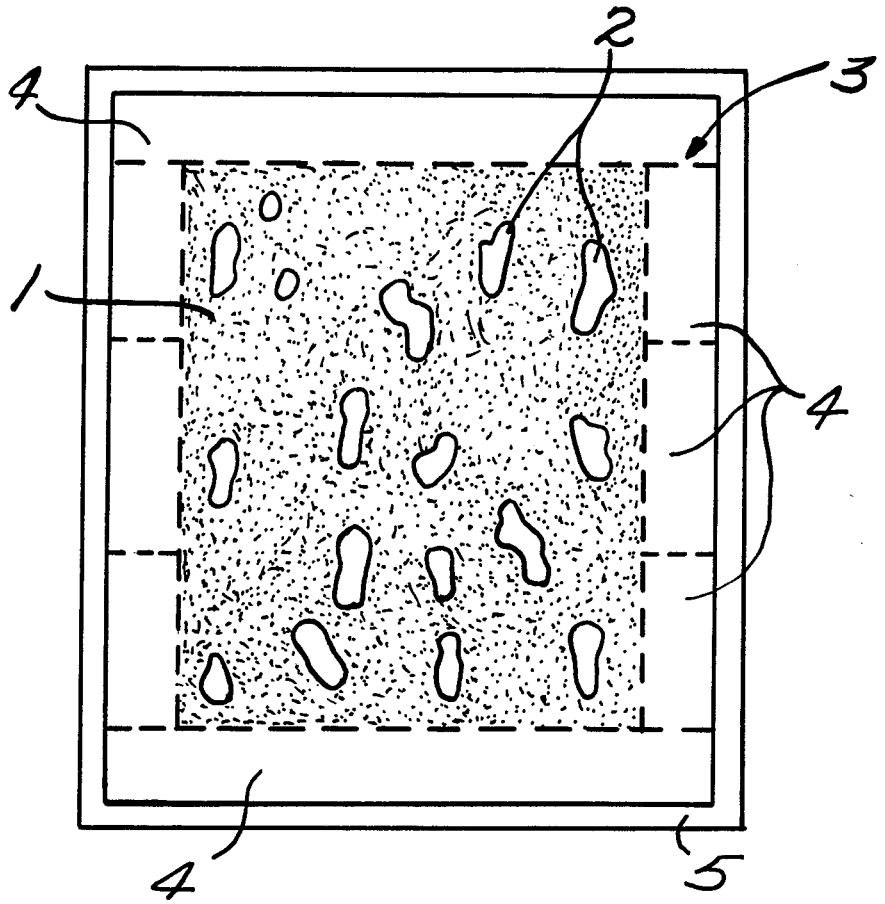
2
3
4
1
4
4
5

MOLDED BODY FOR EMBEDDING RADIOACTIVE WASTE AND PROCESS FOR ITS PRODUCTION

BACKGROUND OF THE INVENTION

The invention is directed to a molded body made of graphite and an inorganic binder for the safe, long time fixation of toxic and radioactive wastes and a process for its production.

Spent fuel elements from nuclear reactors after a certain intermediate storage time must be sent to a final disposal. For this purpose there are discussed two possibilities:

1. The reprocessing of the fuel element with return of the fuel material into the preparation of the fuel element as well as separation, conditioning and final storage of the fission products.

2. The direct storage of the spent fuel elements.

In both cases through a suitable embedding matrix which is especially corrosion and leach resistant or a corresponding container material there must be insured that the enclosed highly active waste remains in the storage place for a thousand years or longer and does not get into the biosphere.

The radioactive waste accumulating in the reprocessing of spent fuel elements must be brought into a form capable of final storage in order to be final stored. Hereby there is required for economical reason a high loading with waste. For this purpose there is needed already before the solidification step a great reduction in volume, for example through evaporation.

There are known several processes for the solidification of highly radioactive waste. For example there is first carried out a calcination of the waste in a fluidized bed between 350° and 900° C. Thereby there is obtained a mixture of oxides, which as powder or granulate is bound in a glass-like on ceramic matrix and therethrough is consolidated to a final storable product.

For the embedding of medium and low active wastes there are known processes according to which the waste material is heated, e.g. with bitumen, and is subjected to an extrusion process. Thereby the radioactive waste is embedded in the bitum matrix, filled hot into drums and final stored.

A further process is the fixation of radioactive waste in cement or concrete. Hereby the waste is processed customarily in the form of a salt concentrate or slurry, which is composed of about 70–80 weight % of liquid and 20–30 weight % of solid components. The slurry is mixed with cement and allowed to set. This process can be carried out directly in the final storage tanks.

Furthermore, there are known processes for the conditioning of radioactive wastes in which the waste is mixed into a resin which is preferably hardenable at room temperature, and then polymerized to a solid block.

These known processes possess a series of disadvantages, especially for the higher activity concentrations. Thus the nitrification of the wastes is carried out at high temperatures, usually above 1000° C. At this temperature several salts are already volatile and must be returned by expensive methods, e.g. off gas purification. This concerns especially the active compounds of cesium and ruthenium. The heat conductivity of the glass matrix is relatively small. In order not to exceed an impermissibly high central temperature of the cask, caused by the residual heat, therefore waste concentration and block diameters are limited to values of about 20 weight % or 20 to 30 cm. Furthermore, there occur through the difference between the thermal coefficients of glass and container material mechanical stresses in the cooling which can lead to undesired stress corrosion and formation of fissures in the glass. The cooling off time necessary for waste casks can amount to several days in order to produce a fissure free package. Therefore this additional process step requires expensive hot cell space.

The bitumenization is usable only on relatively low activity concentrations, e.g. for the so-called liquid middle active waste having a $\beta,\gamma$-activity of about 0.1–1 Ci. Temperatures of 150°–200° C. are necessary which require expensive safety precautions, e.g. against burning. Besides bitumen under irradiation forms radiolysis gases such as, hydrogen.

The simple technique of cementation also has its disadvantages. Thus there are obtained with the same amounts of waste greater volumes of waste, e.g. compared to binding in bitumen 3 to 5 times the volume, a relatively low leach resistance of the product due to the porosity of the cement, and a radiolysis of the waste bound in the cement, which can lead to relatively large amounts of gas such as hydrogen.

For the embedding in polymerizable resins there are basically employed hydrocarbon compounds. Therefore the brittleness of the synthetic resin can be increased by the radiation effect of the radioactive waste and therewith the mechanical integrity of the package can be endangered. It is also true for such molded bodies that there is only a relatively slight resistance to radiolysis and the setting free of hydrogen.

There is known from German OS No. 2,756,700 a process for embeeding radioactive waste in a metal matrix which is formed by isostatically pressing around the waste with metal powder at a temperature between 1000° and 1500° C. The high pressing temperatures and the large consumption of corrosion resistant metal makes it appear that this process has little suitability at least for large bodies and for enclosing volatile radioactive materials.

Besides there are known so-called final storage containers which receive the waste material and which to obtain a sufficiently long interval of corrosion resistance for the most part are built as multilayer containers. As container materials there are used corrosion resistant metallic and non metallic materials.

In German OS No. 2,917,743 (and related U.S. Pat. No. 4,407,742, the entire disclosure of which is hereby incorporated by reference and relied upon) there is described a process in which radioactive and toxic wastes under careful conditions are bound into a good conducting carbon matrix which consists of a mixture of powdered carbon, preferably graphite, with a binding agent, whereby through pressing with the waste mixed in at a temperature above 100° C. there is formed a corresponding molded body. As binding agent there can be employed organic and inorganic materials, the use of sulfur is advantageous and in a preferred embodiment there is employed a mixture of sulfur and nickel which forms the slightly water soluble nickel sulfide at a pressing temperature of about 400° C. It is true that this matrix is corrosion and leach resitanst, but the waste materials can still be dissolved out of the surface layer.

For an economical use of this process there is required the highest possible concentration of waste in the molded body. However, at high portions of waste in the molded body the waste is leached out from ever deeper layers over a long period of time, and finally is leached out of the entire molded body.

Therefore it was the problem of the present invention to provide a molded body made of graphite and an inorganic binder for the safe, long time fixation of radioactive and toxic wastes, which has high density and is corrosion and leach resistant so that the embedded waste cannot be dissolved out even in very long periods of time.

SUMMARY OF THE INVENTION

This problem was solved according to the invention by making the molded body of a combination consisting of a nucleus in which the wastes are embedded and a waste free shell made of the same material.

The graphite matrix for the nucleus and shell thereby is produced in known manner through pressing a mixture of powdered graphite and an inorganic binding agent or the starting components of an inorganic binding agent at a temperature above 100° C. As inorganic binder there can be used sulfur or a stable metal sulfide. It is advantageous to use as graphite an easily modable natural graphite powder.

In employing sulfur as binder there is used a pressing temperature in the region of the melting temperature of the sulfur of about 120° C. as well as molding pressure of 10–50 $MN/m^2$, preferably about 20 $MN/m^2$. A molded body produced in this manner made of nucleus and shell is suitable for toxic and low radioactive waste which produce only a slight specific heat. In medium and highly radioactive wastes a greater heat of decay, is developed especially with highly active waste, which requires the graphite matrix to have a high thermal stability.

The addition of suitable metal or alloy powders for the formation of stable metal sulfides results in very high temperature resistant binders in the graphite matrix. The chemical reaction between metal and sulfur takes place in the mixture of graphite, sulfur and metal or alloy powder by increasing the temperature while pressing the molded body.

As metals there can be employed for example, lead, iron, nickel, cobalt, copper, molybdenum, vanadium or tungsten. There has proven especially advantageous the use of nickel to form nickel sulfide.

In the employment of nickel the sulfide reaction proceeds at a relatively low temperature of about 400° C. and at moderate speed. The nickel sulfide formed in the graphite matrix is distinguished by a high resistance to corrosion and leaching out in corrosive media as well as by a high thermal stability.

The waste free shell advantageously consists of several individual parts joined together. These can be constructed for example in the shape of hemispheres, or be annular shaped or plate shaped. Thereby the joining can be carried out at a temperature about 500° C. and pressures of 30–100 $MN/m^2$. Besides the mechanical integrity of the molded body shell can be increased by pressing in suitable reinforcement. The molded body loaded with waste advantageously can be provided with an additional steel jacket on which are applied the collective manipulation devices for transportation and final storage.

The production of the molded body is carried out in the manner that the blank consisting of the wastes, graphite powder and binder is pressed around on all sides with a shell of graphite powder and binder.

In a further variant of the process powdery or lumpy waste is mixed with the starting components of the graphite matrix and the mixture is filled into a bottom providing hollow cylinder made of the prepressed graphite matrix starting components. After placing a likewise pre-pressed cover on top the body was compressed at a temperature above 100° C. and there resulted a graphite-molded body having a corrosion and leach resistant shell in which the nucleus is joined with the shell in a transitionless manner.

The portion of waste in the nucleus advantageously is between 1 and 70 volume %, preferably between 10 and 50 volume % so that the nucleus is present as a mechanically stable body which has substantially the same physical properties as the waste free shell.

In using sulfur as the sole binder a pressing temperature of 130° C. and a molding pressure of about 20 to 50 $MN/m^2$ is sufficient to produce a very tight corrosion and leach resistant molded body.

When nickel sulfide is employed as the binder for binding in highly radioactive waste materials the union between the inner zone and the shell preferably is carried out at a temperature above 300° C. and a pressure of 30 to 100 $MN/m^2$. Preferably the nucleus is likewise first pre-pressed at room temperature or at elevated temperature and the blank inserted into a pre-pressed hollow cylinder having an attached bottom. After placing on the cover plate the entire molded body is pressed at a temperature above 100° C. and thereby compressed to above 80% of the theoretical density. While maintaining the pressure the temperature was increased to above 400° C., preferably to about 440° C. The molded body was ejected after cooling to below 400° C. had a density above 90% of the theoretical value and is very tight and free from pores which go through it.

The molded body according to the invention is extraordinarily stable chemically, i.e. even in strongly corrosive medium it is still very resistant to corrosion and leaching.

The waste containing nucleus inside the waste free shell has to a great extent, the same physical-chemical properties as the jacket so that mechanical stresses which can cause a fissure of the package are practically eliminated.

BRIEF DESCRIPTION OF THE DRAWING

The drawing schematically show in illustrative form a molded article made according to the invention.

DETAILED DESCRIPTION

Referring more specifically to the drawings the nucleus 1 of the cylindrical molded article consists of a matrix having an inorganic binder in which the granular or lumpy radioactive waste 2 is embedded. The nucleus 1 is surrounded on all sides by the waste free shell 3 with which it is joined without transition. There are shown in dotted lines the places on which the shell 3 is united from preformed ring shaped pieces 4. Additionally the shell 3 is surrounded by a steel jacket 5.

The product can comprise, consist essentially of, or consist of the stated materials and the process can comprise, consist essentially of, or consist of the stated steps with the recited materials.

The molded article of the invention will be explained in more detail in connection with the following examples.

EXAMPLE 1

The molding powder used for the production of the graphite matrix contained the following components, 43.3 weight % natural graphite powder, 20.0 weight % sulfur and 36.7 weight % nickel metal powder. To produce an annular shaped segment having the dimensions:

Outer diameter 450 mm, inner diameter 300 mm, height 200 mm, there were filled into an annular shaped molding die, heatable from the outside, about 58 kilograms of the intensively mixed and subsequently granulated molding powder. The granulate was compressed with a pressure of about 100 $MN/m^2$ in the melting region of the sulfur, at 130° C., the temperature was subsequently raised to about 450° C. while holding the pressure constant and thereby the sulfur reacted with the nickel to form nickel sulfide. After cooling to 350° C. the hollow cylindrically shaped molded body was ejected.

Four annular segments were produced in the manner described and these segments were subsequently joined by molding to form a hollow cylinder having a length of about 800 mm. For this purpose there was required a temperature of 500°-600° C. and a pressure of 50 $MN/m^2$, as joining intermediate layer there was employed in each case a nickel/sulfur powder mixture treated with a small amount of natural graphite (stoichiometric radio of Ni to S being 1:1), the nickel and sulfur likewise reacted under the stated conditions with formation of nickel sulfide. The body plate made of the molding powder of the same composition was joined according to the same process. Correspondingly there was produced a copy plate from the molding powder.

There was inserted into this containerlike hollow space a molding powder of the same matrix, which contains 50 volume % of waste. Then the cover plate was placed on top and under the same conditions as given for the segments the hollow cylinder was united with the hollow cylinder to form a closed shell.

The following properties were ascertained on the molded body:

Density of the Matrix: 3,3 $g/cm^3$
Theoretical density: 99%
Compressive strength: $\perp$ 105 $MN/m^2$ || 107 $MN/m^2$
Heat conductivity: $\perp$ 0.8 W/cm. K || 0.5 W/cm. K
Linear Coefficient: $\perp$ 9.2 $\mu m/m$- K
thermal of extension: || 11.5 $\mu m/m$- K

EXAMPLE 2

To embed in simulated radioactive waste in an inorganically bound graphite matrix the powdery mixture of the starting components of the graphite matrix produced in a manner analogous to Example 1 was mixed with about the same amount of feed clairfication sludge-simulate which consisted of molybdenum, molybdenum (VI) oxide, manganese, manganese (IV) oxide, zirconium, cesium chloride, antimony (III) oxide, stainless steel and nickel powder. This mixture was transferred into the hollow cylinder made of graphite-nickel-sulfur matrix pre-pressed at room temperature and closed on one side. The cylinder was in a die that could be heated from the outside. After placing the cold pre-pressed cover plate on top the entire molded article was compressed in the melting range of sulfur, at 130° C., with a pressure of about 100 $MN/m^2$, the temperature increased to 450° C. at constant pressure and thereby the sulfur reacted to form nickel sulfide. After cooling to about 350° C. the simulate containing molded body was ejected. Besides the physical properties mentioned in Example 1 on this body there were observed particularly low Cs-leaching rates: $3\times10^{-4}$ to $5\times10^{-6}$ cm/d.

EXAMPLE 3

The powdery matrix components graphite, sulfur and nickel were first intensively mixed together according to Example 1. There were mixed into the molding powder formed thereby about 3 cm long sections of fuel rod jackets (jacket diameter outside 10.75 mm; wall thickness 0.68 mm) made of Zircalloy −4. The portion by weight of the compacted or uncompacted jackets is 25 weight %.

The jacket-molding powder mixture is prepressed at room temperature in a floating steel die (inner diameter 50 mm) with a pressure of about 5 $MN/m^2$. The "nucleus" formed thereby (diameter 50 mm, height 80 mm), had about 50% of the theoretical density.

Subsequently the pre-pressed "nucleus" was inserted in a heatable mold in the portion of the shell likewise pre-formed at room temperature and a pressure of 5 $MN/m^2$. The shell consisted of bottom plate, hollow cylinder having an outer diameter of 66 mm and cover plate. After heating to 150° C. the molded article was compressed with a pressure of 50 $MN/m^2$ to about 85% of the theoretical density. While maintaining the pressure the almost finished sample was heated to a temperature of about 440° C. Thereby the nickelsulfur-mixture reacted to form the chemically, mechanically and thermally stable nickel sulfide. Simultaneously the density increased to over 90% of the theoretical density.

After holding for about 10 minutes at the reaction temperature the finished sample was cooled to 350°-400° C. and ejected (diameter 66 mm; height about 75 mm).

What is claimed is:

1. A molded body comprising graphite and an inorganic binder for the safe, long time fixation of radioactive or toxic waste consisting essentially of (1) a nucleus containing the waste bound in a matrix of graphite and inorganic binder and (2) a surrounding shell of the same matrix free of waste, the shell having been pressed on the matrix at a pressure of 10 to 100 $MN/m^2$, the molded body having a density above 90% of the theoretical value and very tight and free from pores which go through the molded body.

2. A molded body according to claim 1 wherein the waste is radioactive waste.

3. A molded body according to claim 1 wherein the inorganic binder is a stable metal sulfide.

4. A molded body according to claim 3 wherein the binder is nickel sulfide.

5. A molded body according to claim 4 wherein the nucleus contains 1 to 70 volume % waste.

6. A molded body according to claim 3 wherein the nucleus contains 1 to 70 volume % waste.

7. A molded body according to claim 1 wherein the nucleus contains 1 to 70 volume % waste.

8. A molded body according to claim 7 wherein the nucleus contains 10 to 50 volume % waste.

9. A molded body according to claim 7 wherein the shell is composed of a plurality of individual parts which are joined together.

10. A molded body according to claim 5 wherein the shell is composed of a plurality of individual parts which are joined together.

11. A molded body according to claim 1 wherein the shell is composed of a plurality of individual parts which are joined together.

12. A molded body according to claim 11 wherein the shell is surrounded by a steel jacket.

13. A molded body according to claim 10 wherein the shell is surrounded by a steel jacket.

14. A molded body according to claim 11 wherein the shell is surrounded by a steel jacket.

15. A molded body according to claim 7 wherein the shell is surrounded by a steel jacket.

16. A molded body according to claim 6 wherein the shell is surrounded by a steel jacket.

17. A molded body according to claim 5 wherein the shell is surrounded by a steel jacket.

18. A molded body according to claim 1 wherein the shell is surrounded by a steel jacket.

19. A molded body according to claim 3 wherein the shell has been pressed on the matrix at a pressure of 30 to 100 $MN/m^2$.

20. A molded body according to claim 1 wherein the pressing pressure is 10 to 50 $MN/m^2$ and the inorganic binder is sulfur.

21. A molded body according to claim 1 having a density which is 99% of the theoretical density.

* * * * *